United States Patent [19]

Bizard

[11] 4,283,807

[45] Aug. 18, 1981

[54] CLEANING OF HEAT EXCHANGERS COMPOSED OF TUBES

[75] Inventor: André G. M. A. Bizard, Paris, France

[73] Assignee: Technos, Paris, France

[21] Appl. No.: 80,144

[22] Filed: Sep. 28, 1979

[30] Foreign Application Priority Data

Oct. 11, 1978 [FR] France ..... 7829014

[51] Int. Cl.[3] ..... B01D 35/02; B08B 9/04

[52] U.S. Cl. ..... 15/3.51; 15/104.06 A; 165/95

[58] Field of Search ..... 15/3.5, 3.51, 104.06 A; 100/112; 165/95; 210/396

[56] References Cited

U.S. PATENT DOCUMENTS 2,801,824 8/1957 Taprogge ..... 15/3.51 X 4,113,008 9/1978 Treplin et al. ..... 165/95

FOREIGN PATENT DOCUMENTS 2541902 4/1976 Fed. Rep. of Germany .

857035 12/1960 United Kingdom ..... 165/95

*Primary Examiner*—Edward L. Roberts

*Attorney, Agent, or Firm*—Wigman & Cohen

[57] ABSTRACT

In a heat exchanger comprising tubes to be cleaned by the injection of compressible balls into the fluid upstream of the tubes, grids are provided downstream of the tubes to enable the balls to be separated from the flow of fluid and reinjected upstream. At least certain of the grids are fixed, their cleaning being carried out by movable combs, the teeth of which clean out the spaces between the bars of the grids.

9 Claims, 12 Drawing Figures

PRIOR ART
FIG.: 1
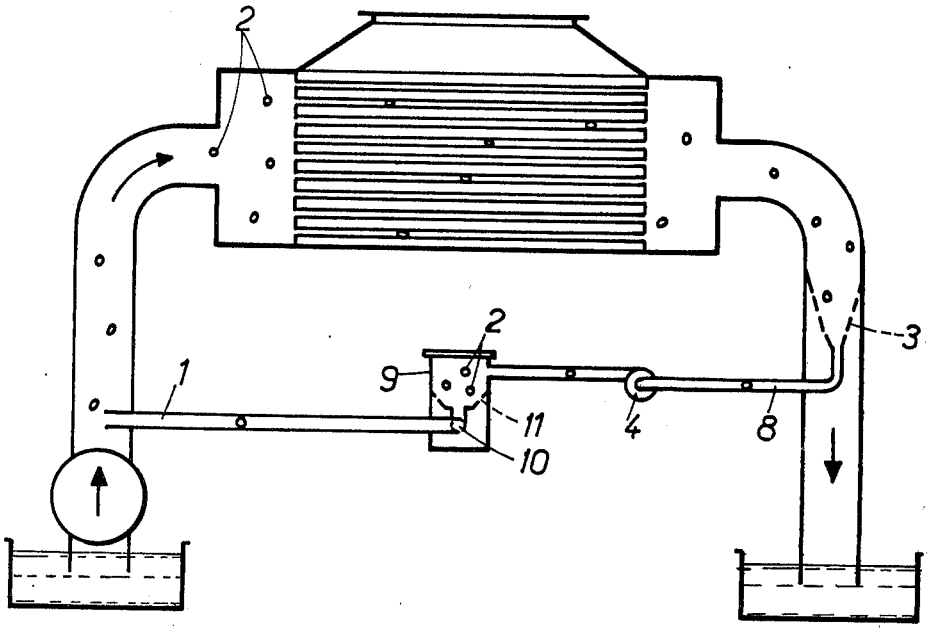
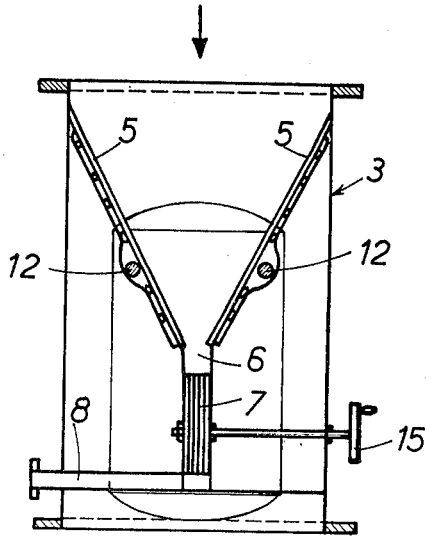
FIG.: 2
PRIOR ART
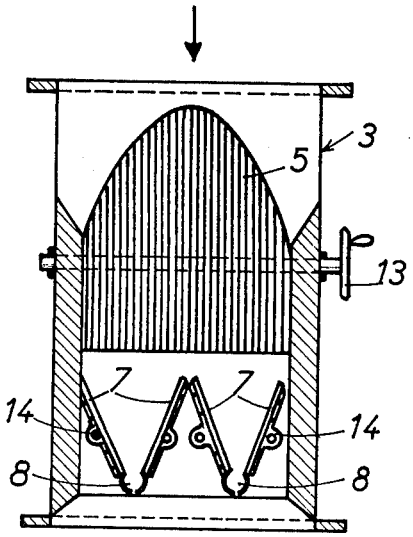
FIG.: 3
PRIOR ART FIG.: 9
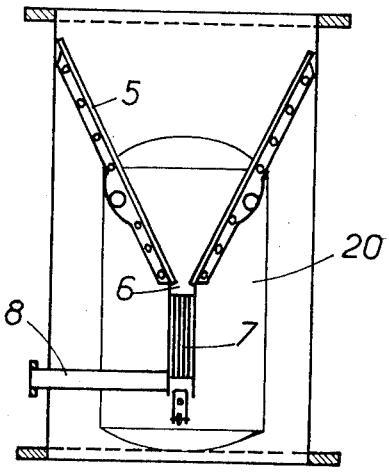
FIG.: 10
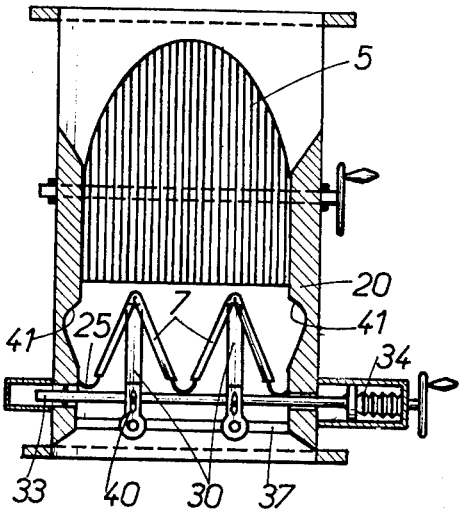
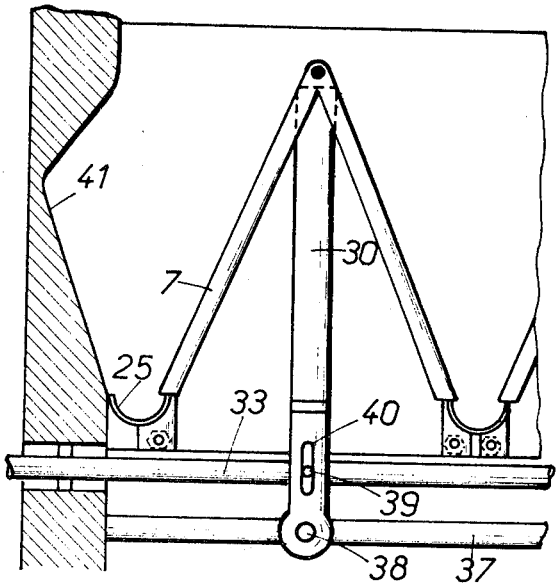
FIG.: 11
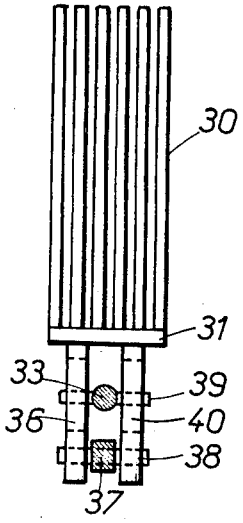
FIG.: 12

CLEANING OF HEAT EXCHANGERS COMPOSED OF TUBES

BACKGROUND OF THE INVENTION

1. Field of the Invention

This invention relates to the cleaning of heat exchangers of the kind comprising tubes through which water or another heat exchanging fluid flows.

2. Description of the Prior Art

A known installation, shown diagrammatically in FIGS. 1 to 3 of the accompanying drawings, comprises an injection tube 1 for continually injecting into the fluid which flows through the exchanger, upstream of the latter (FIG. 1), cleaning balls 2 composed of a flexible and compressible material.

These balls, which have a diameter slightly greater than that of the tubes of the heat exchanger, are carried along by the fluid into the tubes, which they flow through, thus ensuring that the tubes are cleaned.

A separator device 3 located in the outlet pipe of the heat exchanger allows the balls to be collected and conveyed by means of a pump 4 towards the injection tube 1.

The separator device (FIGS. 2 and 3) generally comprises, upstream, two converging grids 5 made up of parallel longitudinal bars, the distance between the bars being less than the diameter of the balls. These grids are each at an angle of from 20° to 30° with respect to the direction of fluid flow. They intercept the balls which, driven along by the force of the current, slide along the bars towards a passage 6 formed by two parallel surfaces situated downstream of the grids (FIG. 2).

The balls are then intercepted by other grids 7 positioned downstream of the grids 5 in such a way that their bars, also longitudinal and parallel, form an angle of from 20° to 30° with respect to the direction of fluid flow. The balls 2 slide along these bars towards inlet pipes 8 of the pump 4.

The various grids of this separator device, the purpose of which is to divert the balls from the fluid flow, also trap the various impurities and detritus of all types which are carried along by the fluid. These, therefore, build up progressively on the grids and it is necessary to ensure periodic cleaning.

This cleaning is generally carried out by the following method: the balls are first of all collected in a sieve 9 by operating a valve 10 located downstream from the pump 4, which ensures that the balls 2 are held in a filtering basket 11 contained in the sieve.

The grids 5 are pivotable about transverse axes 12 parallel to each other, a mechanism 13, such as a crank, allowing them to be turned (FIGS. 2 and 3).

When all the balls have been collected in the sieve 9, the grids 5 are pivoted one towards the other about their axes by means of the cranks, so that the grids are reversed with respect to the direction in which the fluid flows through them, the entry surface of each grid becoming the outlet surface. The impurities held by the grids are thus dislodged and entrained in the fluid.

A similar operation is carried out with the grids 7 which pivot around their axes 14, moved by handwheels 15, for example.

When the grids 5 and 7 have remained in this countercurrent position for a sufficient period for cleaning, they are returned to their initial positions, and the valve 10 in the sieve is operated to allow the balls to circulate once again.

The installation which has just been briefly described has some disadvantages:

A large proportion of the impurities held by the grids 5 slide along the bars of these grids, as do the balls 2 themselves. These impurities are then held by the grids 7. A proportion of these impurities slide along the bars of the grids and are sucked in by the pump 4, but some of them remain wedged on the grids 7.

Consequently, the grids 7, the surfaces of which are much smaller than those of the grids 5, become clogged up much more quickly than the grids 5.

It is therefore the clogging up of the downstream grids 7 which determines the frequency of washing the grids, during which washing the cleaning of the exchanger tubes is no longer effected.

Furthermore, in installations where the fluid is particularly dirty, the clogging up of the grids 7 may be such that washing by the fluid flow is not enough to dislodge all the impurities which are held, so that the grids become permanently clogged up.

Finally, when the clogging up of these grids reaches too high a level, the balls 2 slide less and less easily along the bars and a certain number of them remain immobile on the grids. Not only do these immobile balls no longer take part in the cleaning of the tubes, but they are lost for good since they are carried along with the impurities during the cleaning of the grids by the fluid flow. The loss of these balls, which have to be replaced by new balls, considerably increases the cost of operating the installation.

The main object of this invention is to remedy the disadvantages set out above.

SUMMARY OF THE INVENTION

According to the invention, there is provided a cleaning device for heat exchangers comprising tubes through which a heat exchanging fluid flows, which cleaning device comprises means for injecting balls of a flexible and compressible material into the fluid upstream of the said tubes, grids with parallel bars located downstream of the tubes which allow the balls to be separated from the flow of fluid after passing through the tubes so that they can be reinjected upstream, at least certain of said grids being fixed, and a movable comb associated with each fixed grid, the teeth of which comb are arranged to clean out the spaces between the bars of the grid upon movement of the comb.

The movement of the combs is preferably effected in such a way that the balls and the impurities held by the grids are dislodged against the current so that they are carried along towards the inlet pipes of the pump for recycling the balls. It is an advantage if the cleaning starts with the upstream part of the grids and finishes with the downstream part, so that the dislodged balls and impurities are driven along both by the combs and by the current, which increases the efficiency of the cleaning.

The combs are preferably positioned in such a way that, when cleaning is not being carried out, their teeth are kept parallel to the direction of fluid flow, so as not to impede the flow.

The following advantages result from this invention:

The cleaning of the downstream grids by the combs can be carried out at any time without stopping the circulation of the balls. It can, therefore, be carried out without inconvenience at much more frequent intervals than that of the upstream grids.

The mechanical cleaning of the downstream grids by the combs is much more efficient than the action of a simple counter-current. It guarantees the cleaning of caked on or encrusted impurities.

The balls which are immobilised by the impurities on the grids are no longer lost during cleaning of the grids. They are recirculated towards the inlet pipes of the pump for recycling the balls. A considerable operational saving results from this particular arrangement.

BRIEF DESCRIPTION OF THE DRAWINGS

The following is a more detailed description of various embodiments of the invention, reference being made to the accompanying drawings in which:

FIG. 1 is a diagrammatical view in longitudinal section of the known installation referred to in the introduction to this specification.

FIGS. 2 and 3 show in more detail, in sections through two perpendicular vertical planes, the separator device of the installation of FIG. 1, FIGS. 4 and 5 are similar views to FIGS. 2 and 3 showing a separator device according to this invention, FIGS. 9 and 10 are similar views to FIGS. 4 and 5 but showing an embodiment incorporating oscillating combs, FIG. 11 is a detailed section showing the action of an oscillating comb of the embodiment of FIGS. 9 and 10, and FIG. 12 is a side view of the comb of FIG. 11.

DETAILED DESCRIPTION OF THE PREFERRED EMBODIMENTS

Figure 4:
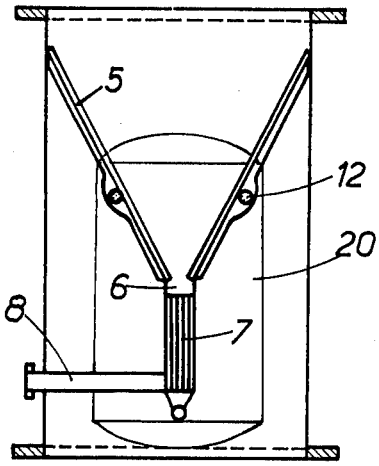

In the separator device of FIGS. 4 to 8, the upstream grids 5 are identical with those of the known separator, these grids being pivotable about axes 12 on a framework 20 mounted in a pipe 21 for insertion in the outlet pipe of the heat exchanger installation. The handwheel mechanism 13 allows the grids 5 to be turned so that they can be placed in the normal operating position shown in the drawing or in the cleaning position, in which their upper ends come into contact, where they are cleaned by the fluid flow.

Figure 7:
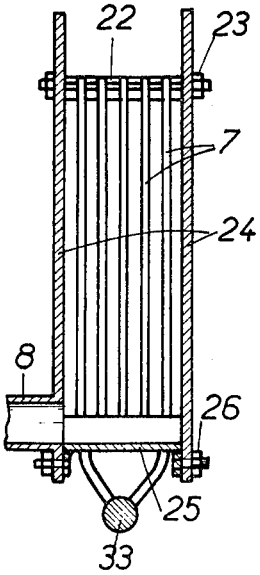
FIG. 7 is a section along the line VII—VII of FIG. 6.

The grids 7, which are positioned in the transverse passage 6 downstream of the grids 5, are fixed and, as shown in FIG. 7, their bars are fixed to stays 22 which are themselves fixed by means of nuts 23 to plates 24 which define the passage for fluid flow and are in their turn attached to the framework 20.

The angle of the bars is in the region of 20° to 30° with respect to the direction of flow of the fluid in the pipe 21. At their lower ends, the bars of the grids 7 are integral with channels 25 which are secured by means of bolts 26 and are in communication with the inlet pipe 8 of the recycling pump 4 for the cleaning balls 2.

Figure 5:
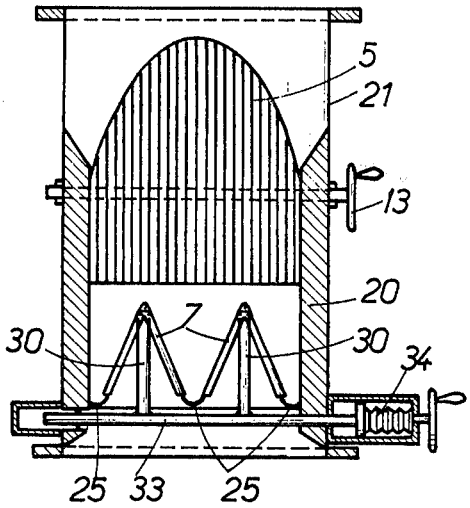

In the present example, there are four grids 7 which guide the balls 2 towards three channels 25 (FIG. 5).

Figure 8:
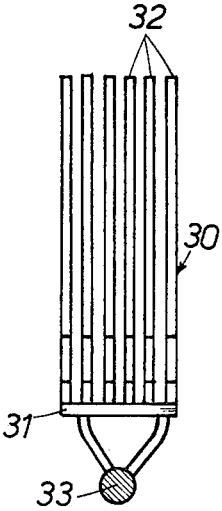
FIG. 8 is a side view of a sliding comb.

The cleaning of the grids 7 is effected by two combs 30 which are shown in detail in FIG. 8 and comprise a base 31 from which there extend upwardly parallel teeth 32, the thickness, number and spacing of which are such that they can pass respectively in the spaces left between the plates 24 and the bars of the grids 7 with a slight clearance so as to be able to clean said spaces.

Figure 6:
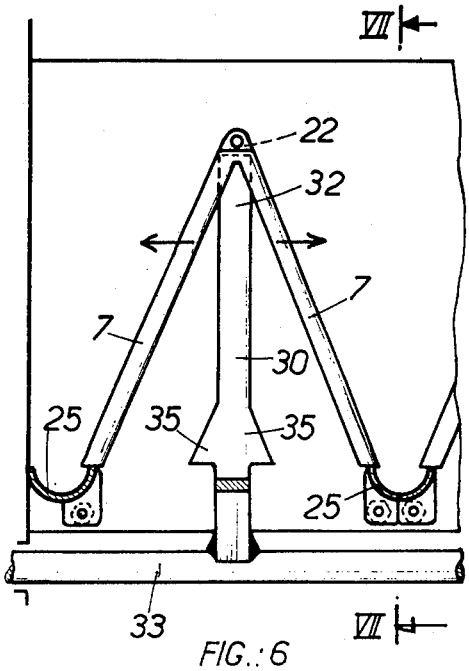
FIG. 6 is a partial detailed view illustrating the action of one of the combs of the device of FIGS. 4 and 5.

The length of the teeth 32 is such that, during their movement, the said teeth 32 remain in the spaces between the bars, which ensures that the teeth are always guided by the bars (FIG. 6).

The two combs are secured to a transverse bar 33, the ends of which are mounted in the framework 20, and a mechanism, such as a screw jack 34, is provided for effecting the required movement of the bar 33, and hence the combs 30, in both directions.

In FIGS. 6 and 8, the lower ends of the teeth 32 are provided with lugs 35 the edges of which are inclined at the same angle as the bars of the grids 7 and which allow the portions of the spaces adjacent the channels 25 to be thoroughly cleaned.

When cleaning is not taking place, the combs 30 can be kept in the middle position as shown in FIGS. 5 and 6 so as not to disturb the flow of fluid.

In the variation shown in FIGS. 9 to 12, the arrangement of the grids 7 is identical to that which has just been described, but the combs 30 are pivotally connected, by means of fork arms 36 provided at the lower end thereof, to a downstream cross-bar 37 mounted on the framework 20, the axes of pivoting 38 being perpendicular to the said cross-bar 37.

The operating bar 33 has pins 39 which are parallel to the axes 38 and which pass into elongate slots 40 in the respective fork arms 36.

Thus, by means of the jack 34, the combs 30 can be oscillated in order to clean the grids 7.

As shown in FIGS. 10 and 11, clearance recesses 41 are provided in the framework 20 so that sufficient space is left for movement of the respective combs 30.

In all other respects, the combs 30 are similar to those in the preceding example.

I claim:

1. A device for cleaning a heat exchanger, having tubes through which a heat exchanging fluid flows, comprising:

(a) at least one grid having bar means, located downstream of the tubes, for separating balls from the flow of the heat exchanging fluid after passage through the tubes;

(b) at least one movable comb having teeth means for passing through the space between the bar means of said at least one grid; and (c) means for moving said at least one movable comb between an operative position, in which the teeth means pass through the space between the bar means so as to clean said at least one grid, and an inoperative position, in which the teeth means are clear of the space between the bar means.

2. Device according to claim 1, in which the at least one movable comb means is arranged for translatory motion.

3. Device according to claim 1, in which the at least one movable comb means is arranged for oscillatory motion.

4. Device according to claim 1, in which the bar means are inclined with respect to the direction of flow of the fluid.

5. Device according to claim 1, in which the teeth means include lug means for passing through the space between the bar means of the at least one grid so as to ensure substantially complete cleaning of said at least one grid.

6. Device according to claim 1, in which the moving means is positioned downstream of the at least one grid.

7. Device according to claim 1, in which the moving means includes a bar extending transversely to the direction of fluid flow and a jack means for moving the bar longitudinally in both directions.

8. Device according to claim 7, in which the at least one movable comb is fixed rigidly to the transversely extending bar.

9. Device according to claim 7, in which the at least one comb is pivotally connected to the transversely extending bar and also to a fixed cross-bar, so as to be capable of oscillation upon longitudinal movement of the bar.

* * * * *